United States Patent [19]

Upchurch

[11] Patent Number: 4,633,945

[45] Date of Patent: Jan. 6, 1987

[54] PERMANENT COMPLETION TUBING CONVEYED PERFORATING SYSTEM

[75] Inventor: James M. Upchurch, Sugar Land, Tex.

[73] Assignee: Schlumberger Technology Corporation, Houston, Tex.

[21] Appl. No.: 677,127

[22] Filed: Dec. 3, 1984

[51] Int. Cl.[4] ..... E21B 43/112

[52] U.S. Cl. ..... 166/55.1; 175/4.52

[58] Field of Search ..... 175/4.52, 4.54, 4.56; 166/55, 55.1, 151, 184

[56] References Cited

U.S. PATENT DOCUMENTS

| | | | |
|---|---|---|---|
| 2,092,337 | 9/1937 | Spencer | 166/55.1 |
| 2,330,509 | 9/1943 | McCullough | 166/55.1 |
| 3,011,551 | 12/1961 | Young et al. | 175/4.54 |
| 3,189,094 | 6/1965 | Hyde | 175/4.52 |
| 3,530,948 | 9/1970 | Garrett | 166/55.1 |
| 3,800,705 | 4/1974 | Tampler | 175/4.54 |
| 4,531,590 | 7/1985 | Peterson | 175/4.52 |

*Primary Examiner*—Stephen J. Novosad
*Assistant Examiner*—William P. Neuder

[57] ABSTRACT

A permanent completion tubing conveyed perforating (TCP) system including a firing head that responds to the difference between annulus and rathole pressure, has a floating piston seal that functions before the guns are dropped to communicate annulus pressure to a closed oil-filled pressure conduit system extending from the piston to the firing head. After the guns are dropped, the piston seals communication between the annulus and the production tubing bore.

1 Claim, 14 Drawing Figures

PERMANENT COMPLETION TUBING CONVEYED PERFORATING SYSTEM

BACKGROUND OF THE INVENTION

1. Field of the Invention

This invention relates to oil industry wellbore perforating, especially perforating by means of tubing conveyed perforating apparatus run in combination with production tubing that permits one-trip well perforating and completing.

2. Description of the Prior Art

Tubing conveyed perforating (TCP) of oil wells has been known for decades, and is now gaining in popularity. Its advantages over wireline conveyed perforating include rig time savings, higher shot density, greater gun length, and the ability to perforate "underbalanced" (i.e. with pressure differential into the borehole) so that perforations are cleansed through formation fluid backflow.

Perforating guns are sometimes run below production tubing to enable the well to be perforated and completed (i.e. put into production) in one operation. Once the guns have fired, they are dropped by means of a gun release mechanism to the bottom of the well, thereby leaving an unobstructed path for the flow of formation fluids up through the tubing.

Various techniques have been used to fire the guns in permanent completion TCP. Typical among these are drop-bar or "go-devil" systems, electrical firing systems and early hydraulic systems, such as the firing in response to sudden exposure through the opening of a valve to the difference between a stored reference pressure and cushion pressure in the tubing. Problems have been encountered, however, in applying the latest "controlled" hydraulic firing techniques, such as described in Applicant's copending U.S. patent applications Ser. Nos. 369,209 and 476,074, to permanent completion TCP.

Such "controlled" hydraulic firing systems offer inherent safety advantages over other systems and are thus attractive candidates for use in permanent completion perforating. For example, in the method set forth in U.S. Ser. No. 369,209 reference, firing occurs in response to the controlled development from the surface of a predetermined pressure differential between pressure in the well annulus (the annular space above the packer between the tubing string and the walls of the borehole) and pressure in the tubing communicating with the "rathole" (the region below the packer in which the guns are positioned). Utilization of such "controlled" hydraulic systems for permanent completion requires solution to the problems of routing annulus or rathole pressure through the packer to the firing head while maintaining an unobstructed flow path and good annulus-to-tubing sealing when the guns (and firing head) are subsequently dropped.

SUMMARY OF THE INVENTION

It is an object of the present invention to provide a permanent completion tubing conveyed perforating (TCP) system to enable the one-trip perforating and producing of a wellbore, wherein perforating guns are fired in response to the development of a predetermined pressure difference between annulus pressure and rathole pressure.

In accordance with the invention, a perforating gun and a predetermined pressure differential responsive firing head are incorporated into a production tubing string. A packer is provided to isolate an interval of wellbore for perforation and subsequent production. A gun drop mechanism is included in the string to discard the gun and firing head from the tubing string after the gun has fired. Means are provided to route pressure to the firing head from the well annulus above the packer and from the isolated interval below the packer for development of the predetermined pressure differential. Means are further provided for sealing communication through the pressure routing means between the annulus and the isolated interval upon dropping the gun.

In an embodiment of the invention, the pressure routing means comprises a flow tube removably received within the bore of the production tubing for communicating annulus pressure from a pressure transfer sub above the packer to the firing head below the packer. The pressure transfer sub includes a floating piston shiftable in a chamber formed with a port opening to the annulus and a port opening to the tubing bore at a point adjacent an entry port of a pressure channel running lengthwise of the flow tube. The piston acts to seal communication between the annulus and the bore when the flow tube is cleared from the tubing after the guns have fired. In one form, the flow tube is wireline retrievable; in another, it is dropped with the guns.

The gun drop mechanism is configured to drop either through application of tubing pressure against a ball dropped to a ball seat, or through release by means of a wireline tool.

BRIEF DESCRIPTION OF THE DRAWINGS

Embodiments of the invention have been chosen for purposes of illustration and description, and are shown in the accompanying drawings forming a part of the specification, wherein.

Throughout the drawings, like elements are referred to by like numerals.

DETAILED DESCRIPTION OF EMBODIMENTS

Figure 1:
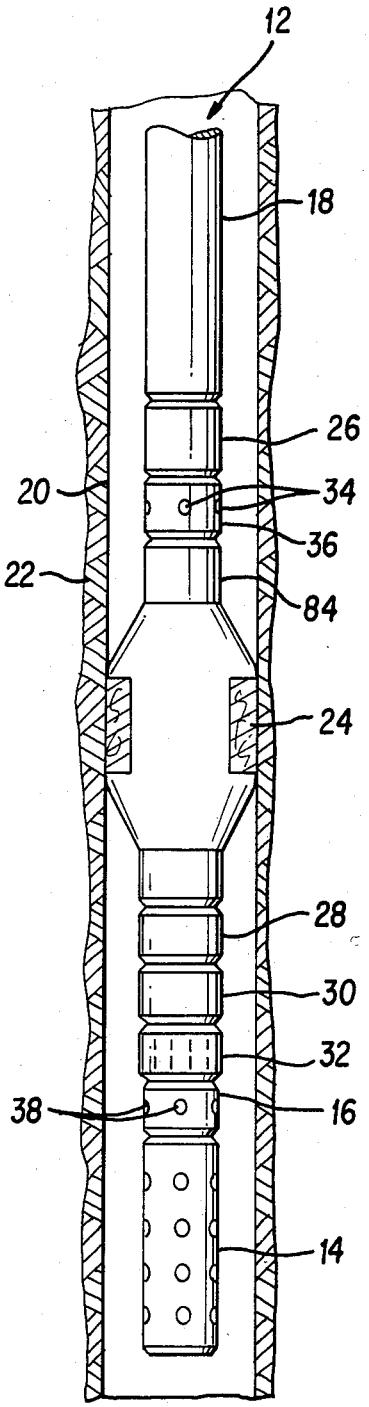
FIG. 1 is a schematic view of a permanent completion TCP system in accordance with the invention.

A example permanent completion TCP system 12 in accordance with the invention includes a perforating gun 14 and a firing head 16 assembled as part of a production tubing string 18 for conveyance into a wellbore 20 which penetrates an earth formation 22. A packer 24 cooperates with the string 18, serves to isolate an interval of the wellbore 20 for perforation of the adjacent earth formation 22 by the gun 14.

The illustrated packer 24 is of a retrievable type that descends into the wellbore 20 as part of the string 18. The packer may, however, be a permanent packer or a seal bore packer with an associated seal bore assembly.

The string 18 further comprises a seating nipple 26, a landing nipple 28, a gun drop sub 30 and a slotted tailpipe 32. The firing head 16 is of the "controlled" hydraulic pressure system type described in Applicant's copending U.S. patent application Ser. Nos. 369,209 and 476,074, the specifications of which are incorporated by reference herein. Well annulus pressure and isolated interval ("rathole") pressure are respectively communicated to the firing head 16 through ports 34 of a pressure transfer sub 36 located above the packer 24 in the string 18 and through ports 38 of the firing head sub 16.

Figure 2:
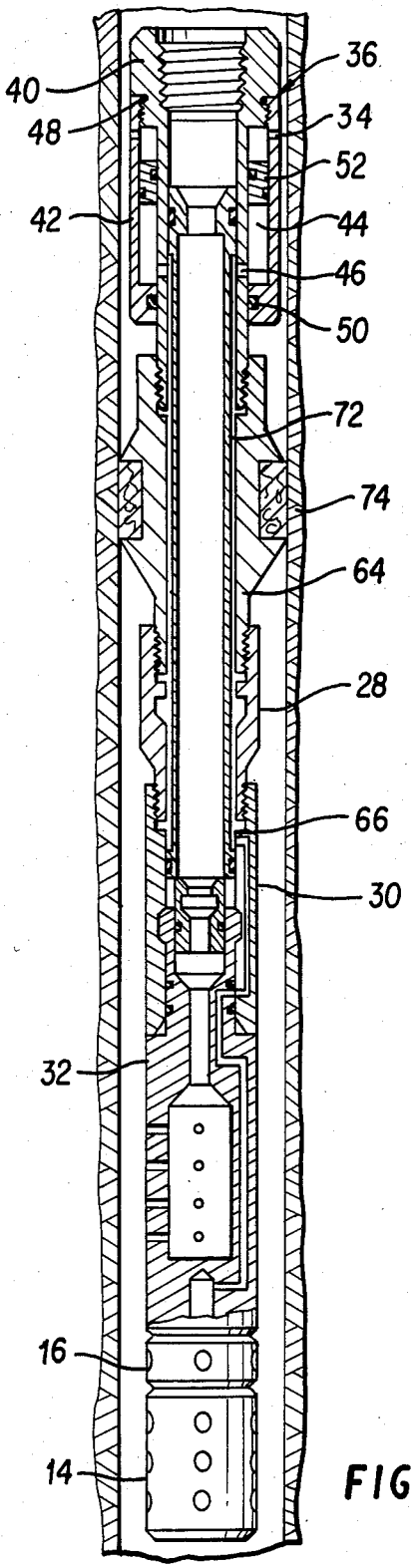
FIG. 2 is a schematic section view of a first embodiment of the system of FIG. 1.
Figure 3A:
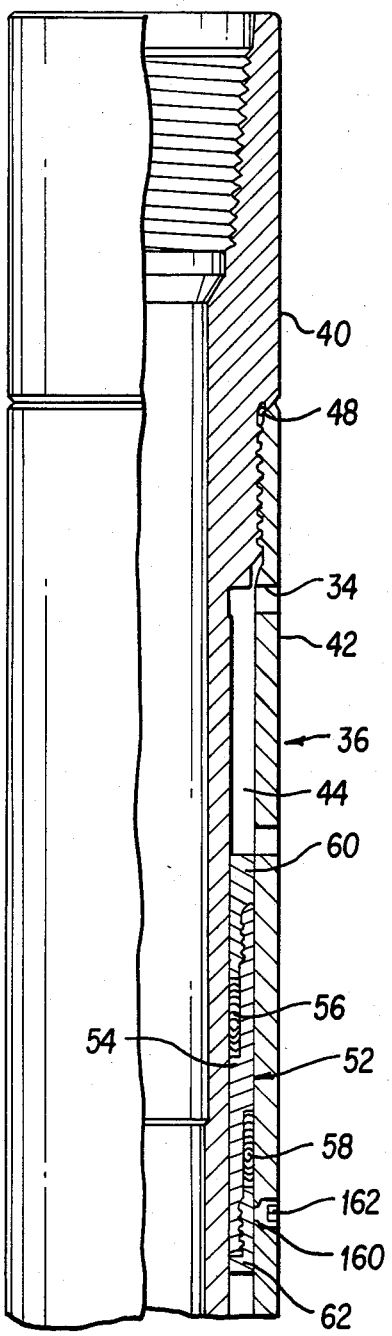
FIGS. 3A and 3B are detailed section views of the pressure transfer sub structure of FIG. 2.
Figure 3B:
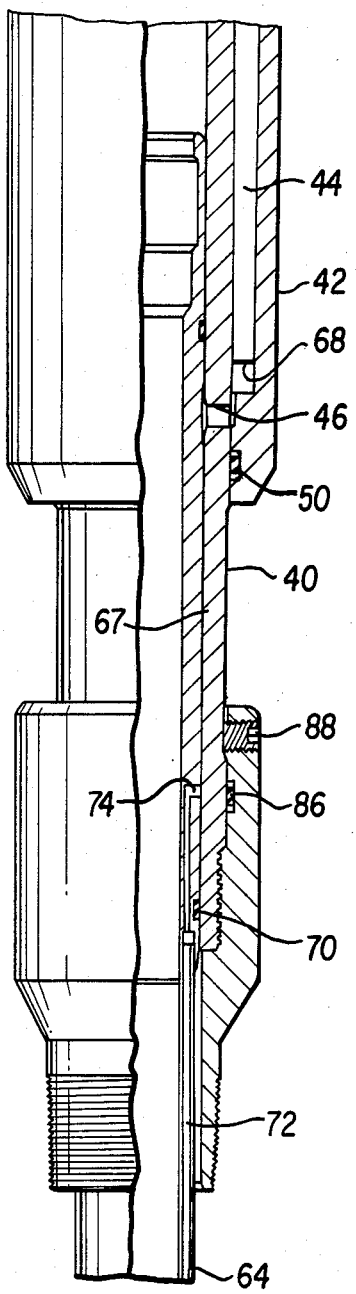

As illustrated in FIGS. 2, 3A and 3B, the pressure transfer sub 36 comprises inner and outer housing sections 40 and 42 between which is formed an annular chamber 44. The upper portion of chamber 44 is open to the well annulus above the packer 24 through the ports 34; the lower portion of the chamber 44 is open to the bore of string 18 through ports 46. O-rings 48 and 50 seal the interconnections of the housings 40 and 42 so that, except for the openings at ports 34 and 46, the chamber 44 is sealed.

Direct communication through the chamber 44 between the annulus at ports 34 and the bore at ports 46 is prevented by means of a floating annular piston 52 located within the chamber 44. The piston 52 serves to seal the chamber 44 against contact of fluids at ports 34 with fluids at ports 46 and is captured between the upper and lower ends of chamber 44 for limited lengthwise shifting therebetween.

Piston 52 is made up of a packing mandrel 54 which is grooved on its inside upper end and its outside lower end to receive V-packing rings 56 and 58, respectively, in sealing engagement with the inner and outer walls of chamber 44. An upper packing retainer 60 serves to keep rings 56 in position, and a lower packing retainer 62 serves to keep rings 58 in position. Movement of piston 52 within the chamber 44 is responsive to the pressures on each side of the piston. Piston 52 may occupy a position bottomed out at the upper end of the chamber (pressure at ports 46 greater than pressure at ports 38); bottomed out at the lower end of the chamber (pressure at ports 38 greater than pressure at ports 46); or a position intermediate the upper and lower ends (a "floating" position in which the pressure at ports 38 and 46 are equal).

A flow tube 64 positioned in the bore of the string 18 serves to communicate the annulus pressure above the packer 24 from the pressure transfer sub 36 to the firing head 16. The tube 64 extends from a point above the ports 46 of the chamber 44 through the packer to a point below a port 66 on the gun drop sub 30 (described further below). At its upper end, the flow tube 64 includes a reduced outer diameter portion 67, which when the tube is positioned in its pressure routing role as shown in FIGS. 2, 3A, 3B, 4A and 4B, serves to provide an annular chamber in communication with the ports 46 of the pressure transfer sub chamber 44. The outer diameter of the tube 64 matches the inner diameter of the housing 40 so that the provision of O-ring seals 68 and 70 (FIG. 3B) above and below the reduced diameter portion 67 provides a sealed chamber. A bore 72 extends internally the length of tube 64 from an entry port 74 connecting with chamber 67 to an exit port 76 connecting with a reduced outer diameter portion 78 (FIG. 4A) of tube 64 at its lower end.

The outer diameter of the tube 64 and the inner diameter of the drop sub 30 are matched, so that the provision of O-ring seals 80 and 82 on the tube 64 above and below the portion 78 provides a sealed annular chamber to communicate port 76 of tube 64 with port 66 of sub 30 when the tube is positioned as shown in the string.

A crossover sub 84 is shown in FIG. 3B providing a transition from an extension of the inner housing 40 of the pressure transfer sub 36 below the outer housing 42 to the packer 24. An O-ring seal 86 is located between the sub 84 and the housing 40 and a set screw 88 provides relative positioning.

The gun drop sub 30 includes a release housing 90 connected by means of a crossover sub 92 to the landing nipple 28 and packer 24. A bore 94 extends lengthwise internally of the housing 90 from the port 66, mentioned previously, to an exit port 96 (see FIGS. 4A and 4B). Within the inside diameter of the release housing 90 is positioned a release sleeve 98. Sleeve 98 is attached by means of a shear pin 100 to the upper section 102 of the collet assembly 104. A plurality of collet fingers 106 (FIG. 4A) extend upwardly from section 104 and are urged into gripping relationship with mating portions 108 on the interior of the release housing 90 by abutment with an external diameter portion 110 of the release sleeve 98. Reduced outer diameter portions 112 and 114 lie respectively above and below the portion 110. The reduced portions 112 and 114 act to permit the release of the fingers 106 away from the mating portions 108 upon longitudinal shifting of the sleeve in a manner described below.

Figure 4A:
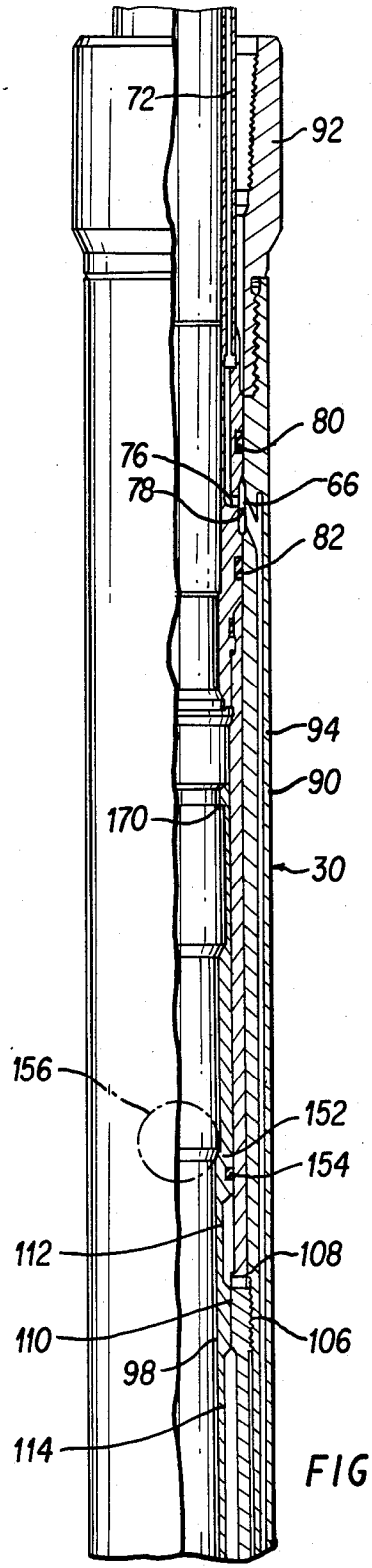
FIGS. 4A and 4B are detailed section views of the gun drop structure of FIG. 2.
Figure 4B:
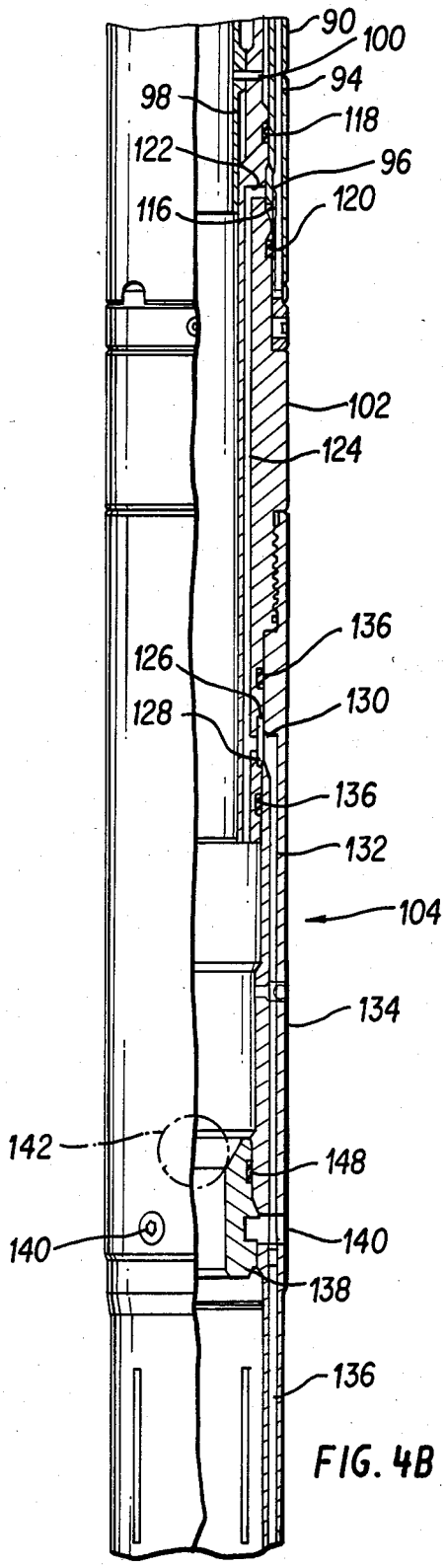

The upper section 102 of the collet assembly 104 has a reduced outer diameter portion 116 at its upper end which is sealed above and below by O-rings 118 and 120 to provide sealed communication between the exit port 96 of the bore 94 of the release housing 90 and an entry port 122 of a bore 124 of section 102 (see FIG. 4B). The lower end of bore 124 has an exit port 126 which communicates via a reduced portion 128 to an entry port 130 of a bore 132 that extends the length of a lower section 134 of the assembly 104. Seals 136 above and below the annular chamber 128 ensure its integrity for pressure communication. Section 134 connects to the tailpipe 32 which includes an internal pressure transmitting channel 136 that connects to a corresponding pressure receiving port on firing head 16.

The pressure transfer sub 36 includes an oil fill port 160 fitted with a removable plug 162. With the system configured as shown in FIGS. 2, 3A and 3B, oil fills a pressure tansmitting channel extending from the portion of chamber 44 below piston 52 to the firing head 16. Annulus pressure is communicated to the firing head 16 indirectly across the floating piston, and then directly from the port 46, through bore 67, port 74 and port 72, to port 76 (FIGS. 4A and 4B), to port 66, bore 94, port 96, port 122, bore 124, port 126, port 130, bore 132, and bore 136, to the annulus pressure receiving port of the firing head. When any part of the gun system is dropped, however, port 46 will be open to the bore of the string 18. This will cause the oil to leave the system and place the lower end of the chamber 44 at tubing pressure. The piston will bottom out to seal the transfer of pressure form the annulus to the tubing.

Figure 9:
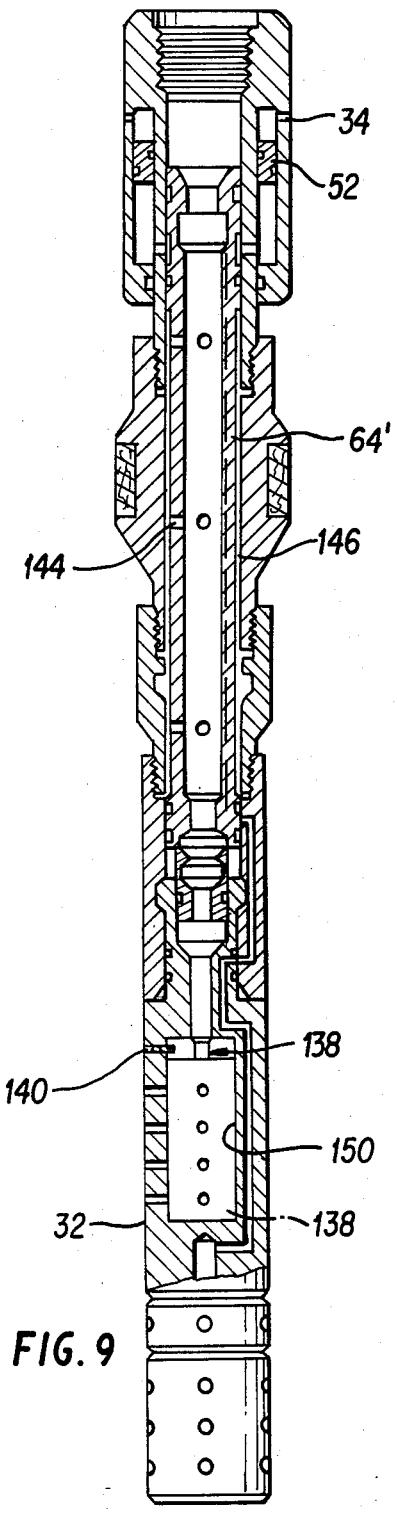
FIG. 9 is a view of a modified form of FIG. 2.

The lower section 134 of the collet assembly 104 may optionally include a ball seat 138 connected at its lower end by means of a shear pin. A ball 142, shown in FIG. 4B in dashed lines, dropped from the surface to land in the ball seat 138 will serve to close off the bore of the string 18 sufficiently to permit the setting of a packer 24 of the hydraulically activated type. FIG. 9 shows an embodiment of present system using a hydraulic packer. The tube 64' is a modified form of the tube 64, with apertures 144 permitting tubular pressure applied from the surface to reach the packer through a reduced annular chamber portion 146 of the tube 64'. Seals 148 prevent leakage during the packer inflate operation. The shear pin 140 is selected to be above the packer inflate pressure, but below the pressure needed to shear the pin 100. When the packer is set, application of additional tubing pressure will shear the pin 140 and drop the ball seat out of the way to the bottom of the interior 150 of the tailpipe 32, as shown by the dot-dash position in FIG. 9.

Figure 7:
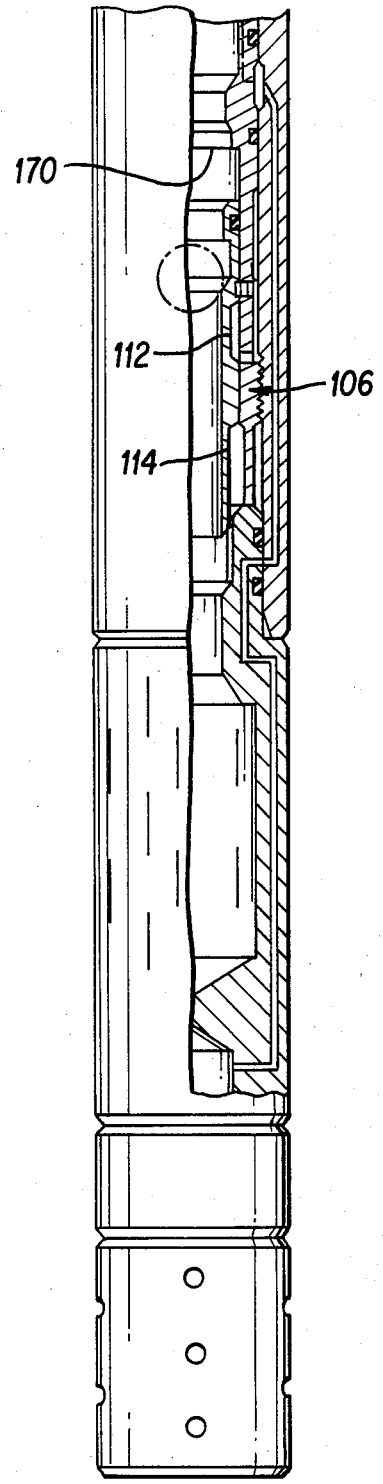
FIGS. 7 and 8 are schematic views useful in understanding the operation of the structure of FIGS. 4A, 4B and 5.

The release sleeve 98 (see FIGS. 4A, 4B and 7) also includes a ball seat 152 and seal 154 which functions in a similar manner to permit the gun assembly to be dropped by tubular pressure. A ball 156 dropped from the surface after the guns have been fired will be positioned in the seat 152. Raising the tubing pressure a sufficient amount from the surface will provide a downward force on the ball 156 and, thus, a force on the sleeve 98 great enough to shear the pin 100 which prevent relative movement between the sleeve 98 and the release housing 90. The sleeve will shift downward, moving the reduced diameter portion 112 of the sleeve 98 adjacent the fingers 106 of the collet assembly 102 instead of the raised portion 110. The fingers 106 will be released from engagement with the mating portions of housing 94. Section 102 and everything below it will thus be dropped to the bottom of the well. For the embodiment shown in FIGS. 4A and 4B, the tube 64 will no longer have support, so it will also drop to the bottom of the well.

The same embodiment (see FIGS. 4A, 4B and 7) can also be dropped by means of a wireline conveyed position tool which is run in to engage the shoulder 170 of the sleeve 98. Upward movement of the tool will move the sleeve 98 upwardly and present the recess 114 adjacent the collet fingers 106, causing dropping of the guns and tube as already described.

Figure 5:
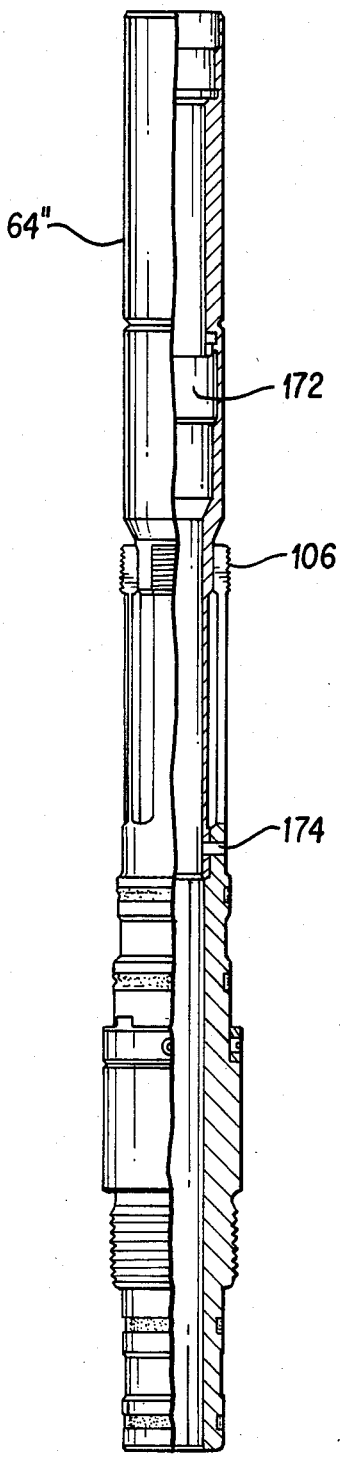
FIGS. 5 and 6 show modified embodiments of the system of FIGS. 4A and 4B.
Figure 8:
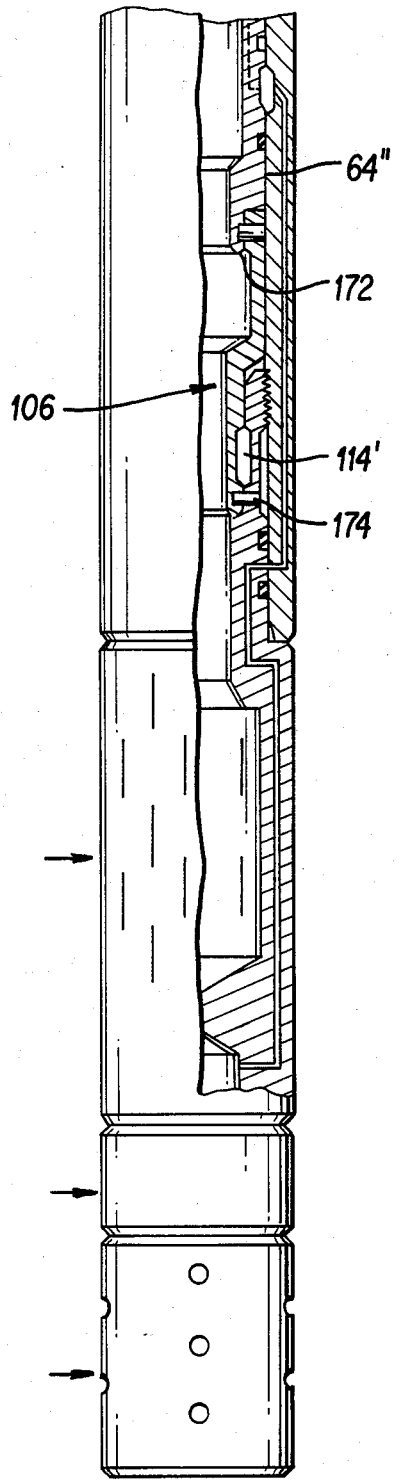

FIGS. 5 and 8 show a modified form of the embodiment in which the flow tube 64 is wireline retrievable back to the surface. A conventional pulling tool can be engaged at position 172 with sufficient upward force to shear pin 174, thereby shifting the collet fingers to recess 114', permitting the tube 64'' to be raised to the surface, and dropping the guns to the wellbore floor.

Figure 10A:
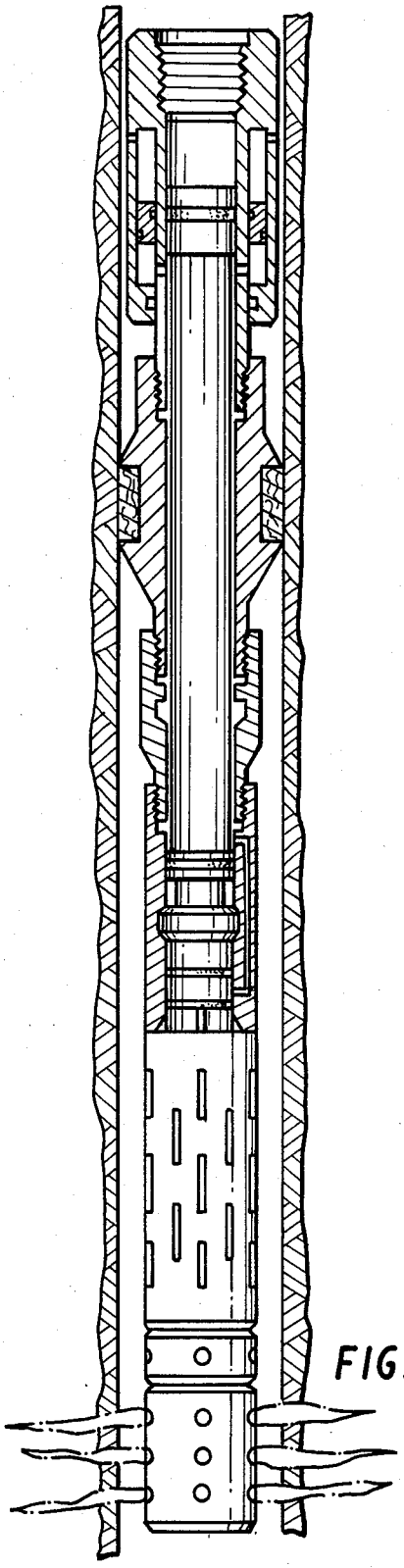
FIGS. 10A–10C are schematic views useful in understanding the operation of the invention.
Figure 10B:
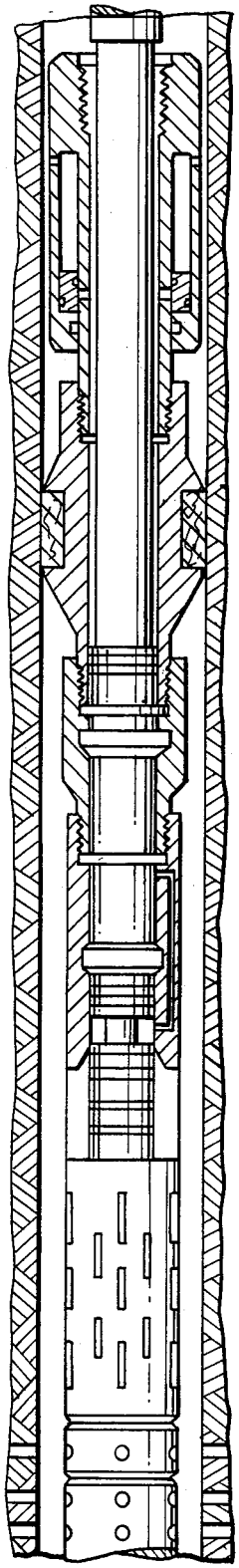
Figure 10C:
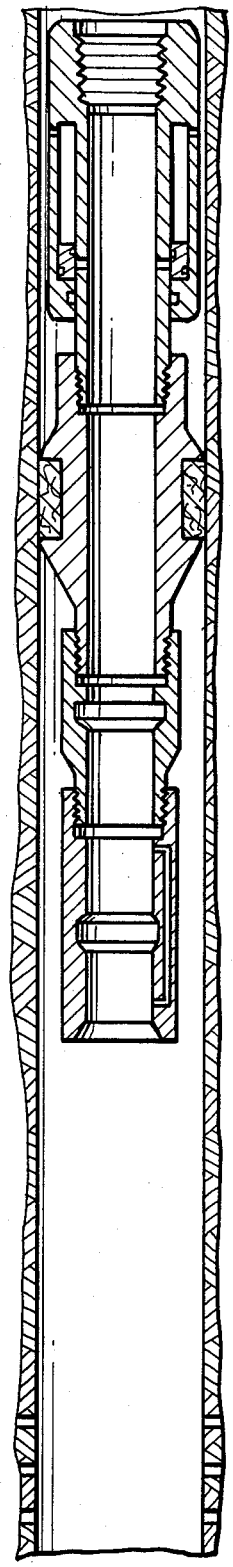

FIGS. 10A–10C show the wireline retrievable flow tube embodiment of the invention in operation. FIG. 10A shows the guns being fired with annulus pressure delivered to the firing head through the pressure transfer sub 36 and the pressure conduit system described previously. The pressure in the closed oil system below the piston 52 is equal to the annulus pressure applied above the piston 52 through the prots 34. In FIG. 10B, a running tool has been used to retrieve the flow tube 64 and the gun is dropping into the hole. FIG. 10C shows the production tubing string remaining in the wellbore following the perforation and completion process.

Figure 6:
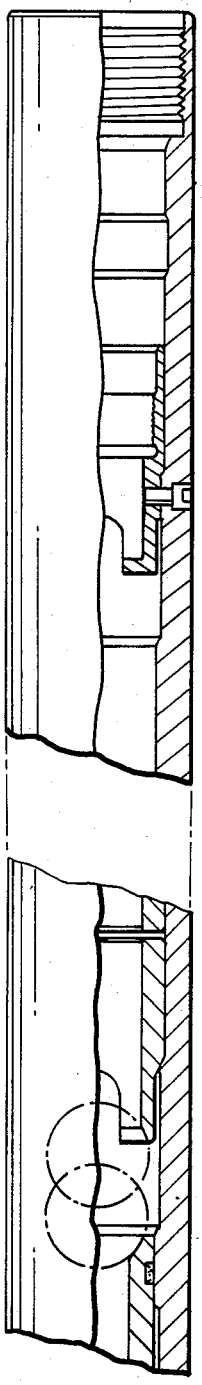

Lastly, FIG. 6 shows the arrangement of FIG. 1 for a modified form of the invention in which the tube 64''' is anchored so that it will not drop. A ball 142' is provided to be run in with the system and remain there for hydraulic packer setting purposes. This is useful where it is desired to test the system.

What is claimed is:

1. A permanent completion tubing conveyed perforating system for a wellbore, comprising:

a production tubing string;

a packer cooperating with said string to isolate an interval of the wellbore;

a perforating gun incorporated into said string for perforating said wellbore in said isolated interval;

a firing head incorporated into said string, said firing head being responsive to development thereacross of a predetermined difference between the pressure of fluids in the well annulus above said packer and the pressure of fluids in said isolated interval;

a gun removal mechanism included in the string to remove said gun and said firing head from the string after the gun has fired, leaving a passage for the flow of formation fluids from said isolated interval to the surface through said string;

means to route pressure to the firing head from said well annulus and from said isolated interval for development of said predetermined pressure; and piston means for sealing communication through the pressure routing means between the annulus and the isolated interval upon removal of the gun and the firing head from the string.

* * * * *